US011058176B2

(12) United States Patent
Welliver et al.

(10) Patent No.: US 11,058,176 B2
(45) Date of Patent: Jul. 13, 2021

(54) SOLE STRUCTURE WITH PROGRESSIVELY ANGLED TRACTION ELEMENTS

(71) Applicant: NIKE, Inc., Beaverton, OR (US)

(72) Inventors: Adam R. Welliver, Beaverton, OR (US); Carl L. Madore, Portland, OR (US); Tobie D. Hatfield, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 145 days.

(21) Appl. No.: 16/562,809

(22) Filed: Sep. 6, 2019

(65) Prior Publication Data

US 2020/0107611 A1 Apr. 9, 2020

Related U.S. Application Data

(60) Provisional application No. 62/743,141, filed on Oct. 9, 2018.

(51) Int. Cl.

| | |
|---|---|
| ***A43B 13/22*** | (2006.01) |
| ***A43B 13/37*** | (2006.01) |
| ***A43C 15/00*** | (2006.01) |
| ***A43C 15/16*** | (2006.01) |

(52) U.S. Cl.

CPC ..... *A43B 13/223* (2013.01); *A43B 13/37* (2013.01); *A43C 15/00* (2013.01); *A43C 15/162* (2013.01)

(58) Field of Classification Search

CPC ..... A43B 13/223; A43B 13/22; A43C 15/00; A43C 13/00; A43C 15/162; A43C 15/165; A43C 16/167; A43C 15/18

USPC ..... 36/59 C, 67 R, 59 R, 134; D2/951, 953, D2/960

See application file for complete search history.

(56) References Cited

U.S. PATENT DOCUMENTS

| | | | | | |
|---|---|---|---|---|---|
| 3,006,085 | A | * | 10/1961 | Bingham, Jr. | A43B 13/223 36/590 |
| 3,507,059 | A | * | 4/1970 | Vietas | A43B 13/223 36/59 R |
| 3,961,428 | A | * | 6/1976 | Sidles | A43B 3/16 36/32 R |
| 4,045,888 | A | * | 9/1977 | Oxenberg | A43B 5/00 36/114 |
| 4,060,917 | A | * | 12/1977 | Canale | A43B 13/223 36/59 C |
| D398,440 | S | * | 9/1998 | Rowland | D2/951 |
| 5,918,385 | A | * | 7/1999 | Sessa | A43B 13/223 36/59 C |

(Continued)

FOREIGN PATENT DOCUMENTS

| | | |
|---|---|---|
| DE | 1211091 B | 2/1966 |
| FR | 1093920 A | 5/1955 |

*Primary Examiner* — Marie D Bays
(74) *Attorney, Agent, or Firm* — Quinn IP Law

(57) ABSTRACT

A sole structure includes an outsole having an outsole body defining an inner body surface and an outer body surface opposite the inner body surface. The outsole has a plurality of traction elements each extending from the outsole body away from the inner body surface. Each of the traction elements includes a base coupled to the outsole body surface. Each of the traction elements includes a tip spaced apart from the outer body surface and has a pitch defined by a vector. The pitch of each of the plurality of traction elements varies as a function of a distance from the central axis to a respective traction element.

23 Claims, 6 Drawing Sheets

(56) References Cited

U.S. PATENT DOCUMENTS

| | | | | |
|---|---|---|---|---|
| 6,401,367 | B2 * | 6/2002 | Lancon | A63C 13/00 36/115 |
| D490,225 | S * | 5/2004 | McClaskie | D2/960 |
| 8,578,630 | B2 * | 11/2013 | Diepenbrock | A43B 17/00 36/59 R |
| D735,983 | S * | 8/2015 | Cietto | D2/960 |
| D843,095 | S * | 3/2019 | Birkinhead | D2/957 |
| 2002/0166263 | A1 * | 11/2002 | Sink | A43C 15/16 36/127 |
| 2005/0081406 | A1 * | 4/2005 | Hoffer | A43B 13/223 36/59 R |
| 2005/0217150 | A1 * | 10/2005 | Hoffer | A43B 13/223 36/59 R |
| 2011/0167672 | A1 * | 7/2011 | Bond | A43B 13/223 36/28 |
| 2015/0351493 | A1 * | 12/2015 | Ashcroft | A43D 1/025 36/132 |
| 2018/0242688 | A1 * | 8/2018 | Madore | A43B 5/001 |
| 2020/0107611 | A1 * | 4/2020 | Welliver | A43B 13/223 |

* cited by examiner

SOLE STRUCTURE WITH PROGRESSIVELY ANGLED TRACTION ELEMENTS

CROSS-REFERENCE TO RELATED APPLICATION

This application claims priority, and the benefit of, U.S. Provisional Patent Application No. 62/743,141, filed on Oct. 9, 2018, the entire disclosure in which is incorporated by reference herein.

TECHNICAL FIELD

The present disclosure relates to a sole structure for an article of footwear. In particular, the present disclosure relates to a sole structure including an outsole and traction elements pointing toward a central axis of the outsole.

BACKGROUND

Footwear typically includes a sole configured to be located under a wearer's foot to space the foot away from the ground or floor surface. Soles can be designed to provide a desired level of cushioning. The ground contact surface of the article of footwear can be configured for durability.

DETAILED DESCRIPTION

Figure 1:
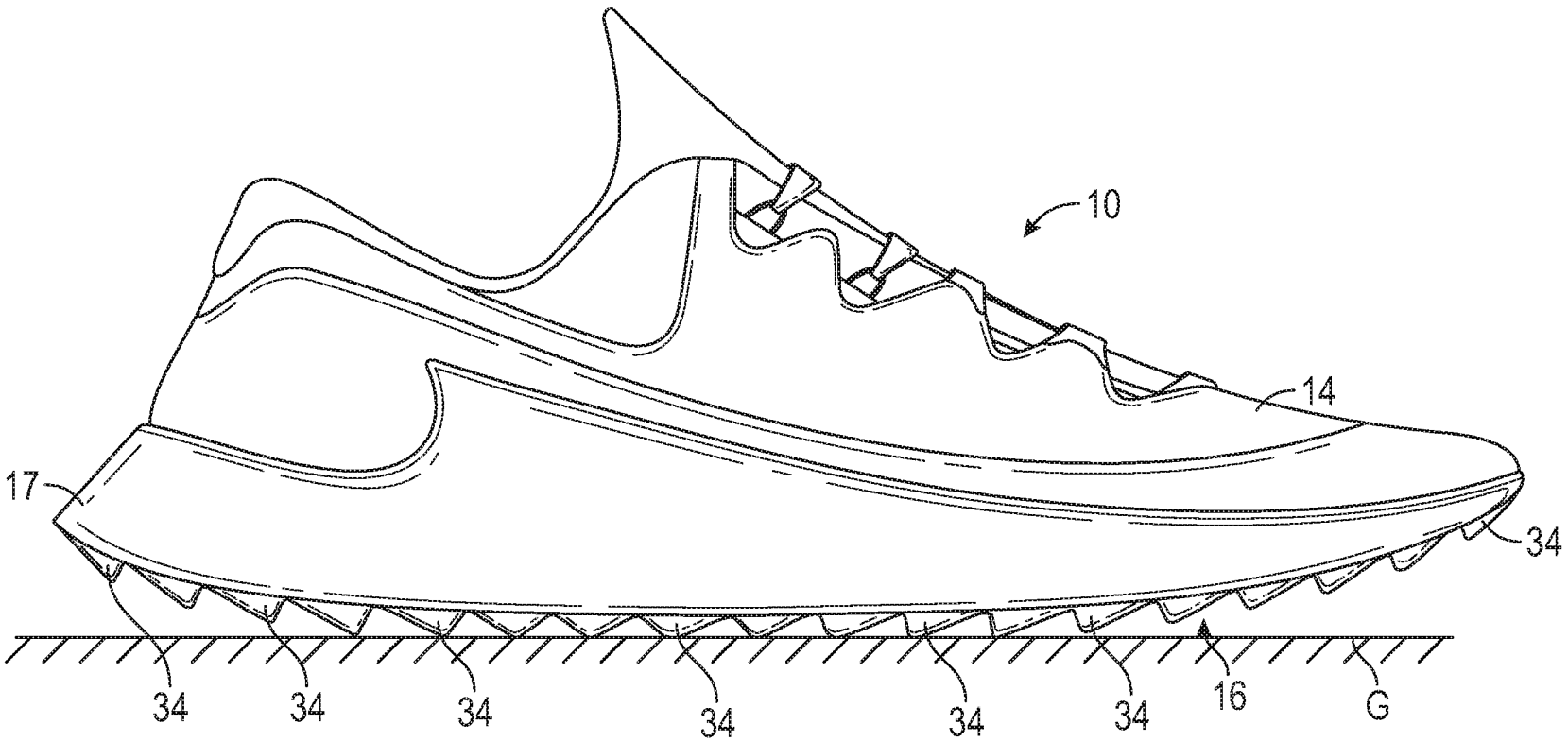
FIG. 1 is a schematic side view of an article of footwear including a sole structure.

The following discussion and accompanying figures disclose articles of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

The term "forward" is used to refer to the general direction in which the toes of a foot point, and the term "rearward" is used to refer to the opposite direction, i.e., the direction in which the heel of the foot is facing. In some cases, a component may be identified with a longitudinal axis as well as a forward and rearward longitudinal direction along that axis.

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole structure). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed farther from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

The term "side," as used in this specification and in the claims, refers to any portion of a component facing generally in a lateral, medial, forward, or rearward direction, as opposed to an upward or downward direction. The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot. In some cases, a component may be identified with a lateral axis, which is perpendicular to a longitudinal axis. Opposing directions along the lateral axis may be directed towards the lateral and medial sides of the component.

The term "upwards" refers to the vertical direction pointing towards a top of the article, which may include an instep, a fastening region and/or a throat of an upper. The term "downwards" refers to the vertical direction pointing opposite the upwards direction, and may generally point towards the sole, or towards the outermost components of the sole.

The "interior" of a shoe refers to space that is occupied by a wearer's foot when the shoe is worn. The "inner side" of a panel or other shoe element refers to the face of that panel or element that is (or will be) oriented toward the shoe's interior in a completed shoe. The "outer side" or "exterior" of an element refers to the face of that element that is (or will be) oriented away from the shoe's interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or upper. Thus, the terms proximal and distal may be understood to provide generally opposing terms to describe the relative spatial position of a footwear layer.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

The present disclosure includes a sole structure for an article of footwear. The sole structure includes an outsole that has a maximum outsole length and extends along a longitudinal axis, wherein the maximum outsole length has an outsole midpoint. The outsole defines a central axis intersecting the outsole midpoint of the maximum outsole length of the outsole. The central axis is perpendicular to the longitudinal axis. The outsole includes an outsole body defining an inner body surface and an outer body surface opposite the inner body surface. The outsole includes a plurality of traction elements each extending from the outsole body away from the inner body surface. Each of the plurality of traction elements includes a base coupled to the outer body surface. The base has a maximum base length, and the maximum base length has a base midpoint. Each traction element includes a tip spaced apart from the outer body surface. Each of the plurality of traction elements has a pitch defined by an angle between an incline vector and a vector normal to the outer body surface. The incline vector extends from the base midpoint of the maximum base length of the base to the tip. The pitch of each of the plurality of traction elements increases as an increasing function of a distance from the central axis to a respective traction element of the plurality of traction elements. Each of the plurality of traction elements points toward the central axis.

The outsole has a forefoot region, a heel region, and a midfoot region between the forefoot region and the heel region. Each of the plurality of traction elements defines a traction axis. The traction axis intersects the tip and the longitudinal axis. The longitudinal axis is perpendicular to the traction axis. The traction axis is parallel to the vector normal to the outer body surface. At least one of traction elements is located in the midfoot region. At least one of the traction elements that is located in the midfoot region is symmetrical about the traction axis. The angle of the plurality of traction elements increases as the distance from the central axis to the respective traction element of the plurality of traction elements increases. The base has a first base end and a second base end opposite the first base end. The distance from the first base end to the base midpoint along the longitudinal axis is equal to the distance from the second base end to the base midpoint along the longitudinal axis. The maximum base length of the base is defined from the first base end to the second base end along the longitudinal axis. The outsole includes a forwardmost edge and a rearmost edge opposite the forwardmost edge. The maximum outsole length is defined as a distance from the forwardmost edge to the rearmost edge of the outsole along the longitudinal axis. The distance from the forwardmost edge to the outsole midpoint along the longitudinal axis is equal to the distance from the rearmost edge to the outsole midpoint along the longitudinal axis.

Each of the plurality of traction elements may extend directly from the outer body surface of the outsole body. At least one of the traction elements is located in the forefoot region and is not symmetrical about the traction axis. At least one of the traction elements is located in the heel region and is not symmetrical about the traction axis.

The outsole defines a plurality of grooves extending through an entire thickness of the outsole body. The traction elements are arranged in a plurality of rows that extends between the forefoot region and the heel region. The outsole has a perimeter that defines a perimeter contour. The perimeter contour has a variable perimeter curvature along the perimeter of the outsole. Each of the rows has a row contour. The row contour has a variable row curvature. The outsole defines a distance from the longitudinal axis to a respective row of the plurality of rows. The variable row curvature is closer to the variable perimeter curvature as the distance from the longitudinal axis to the respective row of the plurality of rows increases. The outsole includes a plurality of anti-rotation areas. The traction elements include a group of traction elements at each of the plurality of anti-rotation areas. Each traction element of the group of traction elements has a height that is greater than a height of each of the plurality of traction elements that is not located in the anti-rotation areas. The outsole includes six anti-rotation areas each spaced apart from each other. At least two of the anti-rotation areas are in the forefoot region of the outsole. At least two of the anti-rotation areas are in the heel region of the outsole. The outsole includes a first anti-rotation traction element, a second anti-rotation traction element, a third anti-rotation traction element, a fourth anti-rotation traction element, a fifth anti-rotation traction element, a sixth anti-rotation traction element, a seventh anti-rotation traction element, an eighth anti-rotation traction element, and a ninth anti-rotation traction element. The first anti-rotation traction element, the second anti-rotation traction element, and the third anti-rotation traction element each have the same height. The first anti-rotation traction element, the second anti-rotation traction element, and the third anti-rotation traction element are each disposed along a first row of the plurality of rows. The fourth anti-rotation traction element and the fifth anti-rotation traction element are disposed along a second row. The second row is immediately adjacent to the first row. The sixth anti-rotation traction element is disposed along a third row of the plurality of rows. The third row is immediately adjacent to the second row. The seventh anti-rotation traction element and the eighth anti-rotation traction element are disposed along a fourth row. The fourth row of the plurality of rows is immediately adjacent the first row. The ninth anti-rotation traction element is disposed along a fifth row that is immediately adjacent the fourth row.

The present disclosure also describes an article of footwear including an upper and a sole structure as described above. The sole structure is coupled to the upper.

The above features and advantages and other features and advantages of the present teachings are readily apparent from the following detailed description of the best modes for carrying out the teachings when taken in connection with the accompanying drawings.

Figure 2:
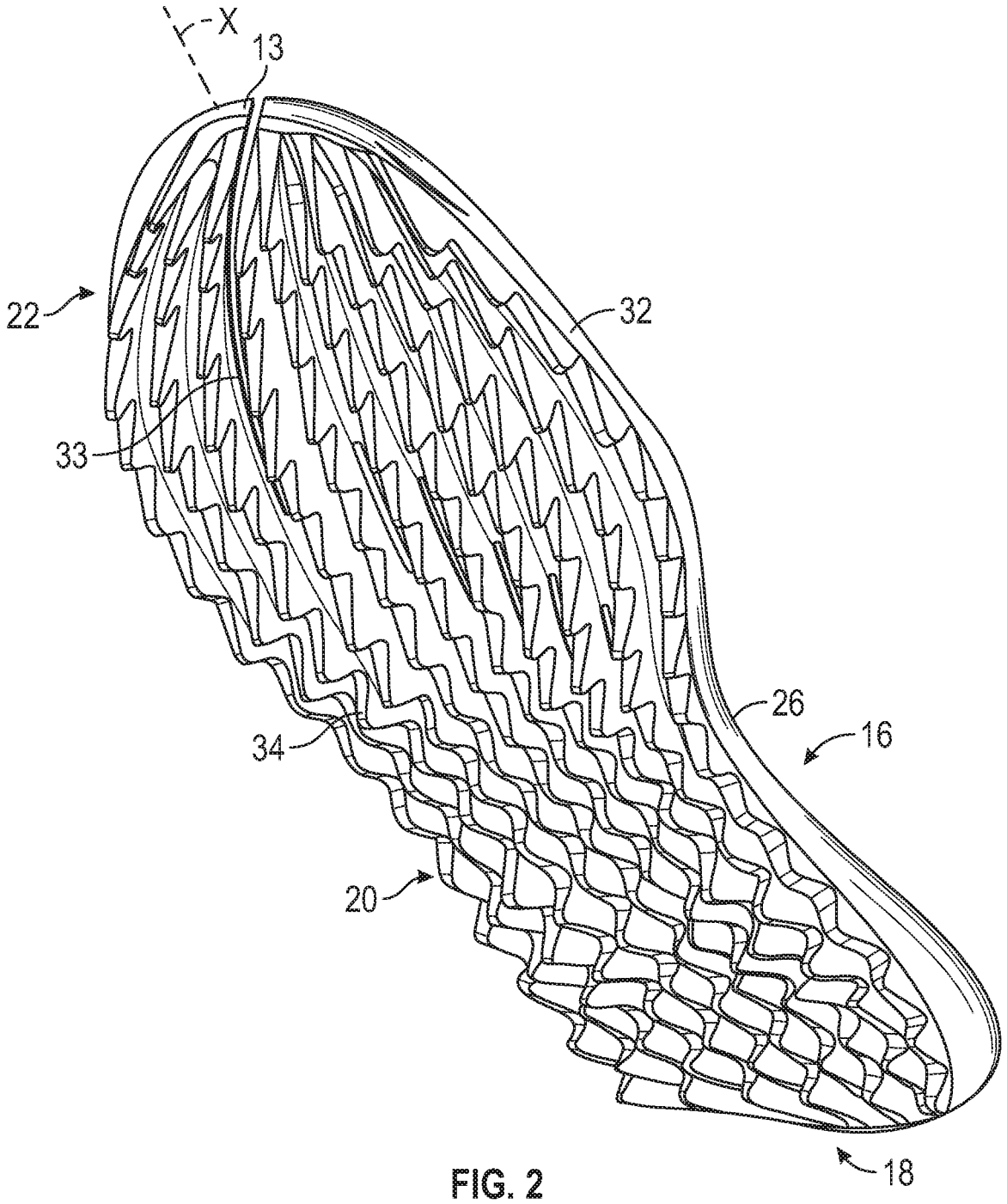
FIG. 2 is a schematic bottom perspective view of the sole structure of FIG. 1.

Referring to the drawings, wherein like reference numbers correspond to like or similar components throughout the several figures, FIGS. 1 and 2 schematically illustrate a sole structure 12 for an article of footwear 10. The article of footwear 10 further includes a footwear upper 14 (FIG. 1) secured to the sole structure 12. As a non-limiting example, the article of footwear 10 may be a golf shoe for speed golf. Speed golf is a type of golf which scores both on strokes played and the time taken to complete the round. The sole structure 12 includes an outsole 16 configured to contact the ground G and a midsole 17 disposed between the outsole 16 and the upper 14. The midsole 17 may be wholly or partly made of compressed ethylene vinyl acetate (EVA) foam to provide lightweight comfort and stability. Additionally, the sole structure 12 may include an insole disposed over the midsole to provide additional cushioning.

Figure 3:
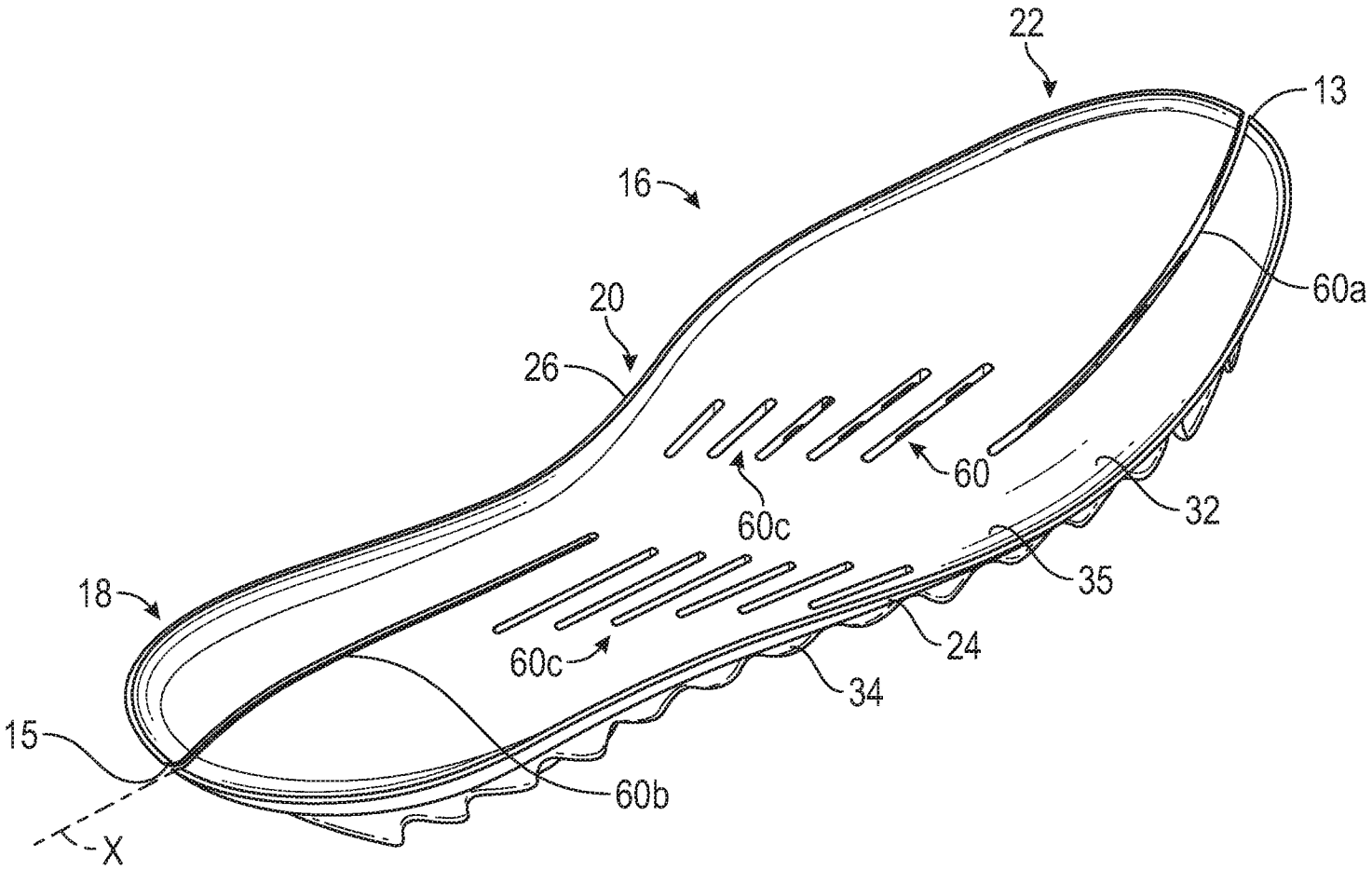
FIG. 3 is a schematic top perspective view of the sole structure of FIG. 1.
Figure 4:
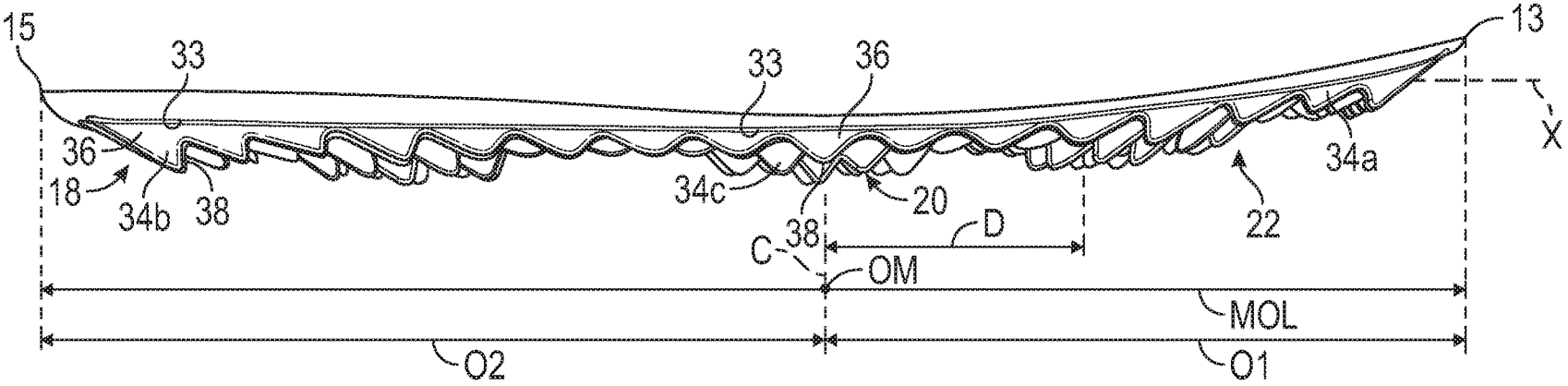
FIG. 4 is a schematic side view of the sole structure of FIG. 1.
Figure 7:
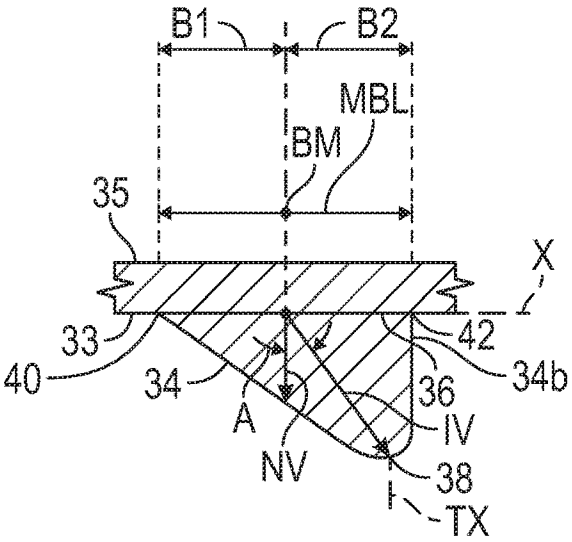
FIG. 7 is a schematic sectional side view of a heel traction element of the sole structure of FIG. 1.
Figure 6:
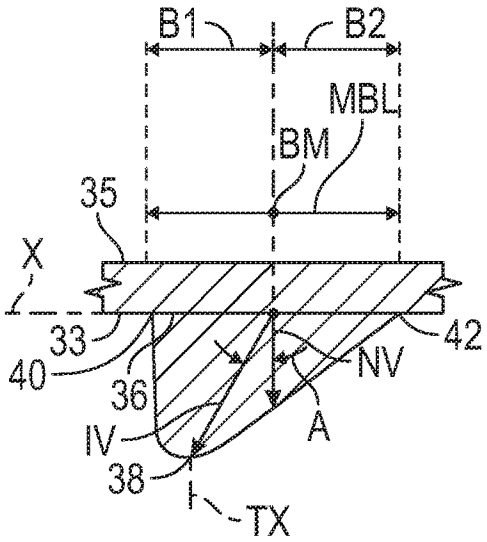
FIG. 6 is a schematic sectional side view of a forefoot traction element of the sole structure of FIG. 1.
Figure 5:
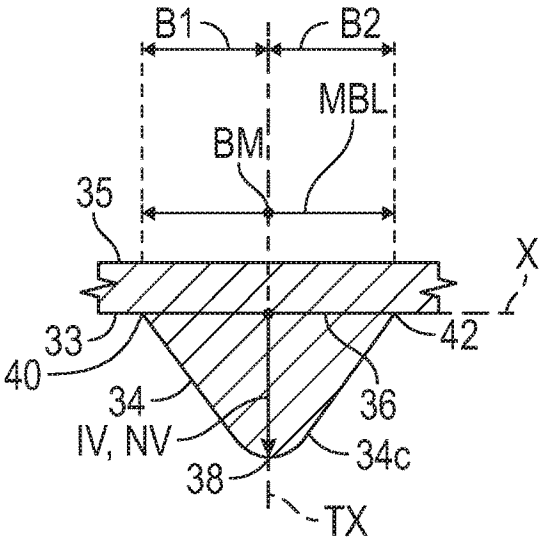
FIG. 5 is a schematic sectional side view of a midfoot traction element of the sole structure of FIG. 1.

With reference to FIGS. 2-4, the outsole 16 extends along a longitudinal axis X and has a maximum outsole length MOL, and the longitudinal axis X extends along the maximum length MOL of the outsole 16. The maximum outsole length MOL is defined as the distance from a forwardmost edge 13 to a rearmost edge 15 of the outsole 16 along the longitudinal axis X. The outsole 16 has a heel region 18, a midfoot region 20, and a forefoot region 22. The midfoot region 20 is between the heel region 18 and the forefoot region 22. In the present disclosure, the heel region 18, the midfoot region 20, and the forefoot region 22 are defined as the rearmost third, the middle third, and the foremost third of the outsole 16, respectively. The heel region 18 generally includes portions of the outsole 16 corresponding with rear portions of a human foot including the calcaneus bone and of a size corresponding with the outsole 16 and article of footwear 10. The forefoot region 22 generally includes portions of the outsole 16 corresponding with the toes and the joints connecting the metatarsals with the phalanges of the human foot of the size corresponding with the outsole 16 and article of footwear 10. The midfoot region 20 generally includes portions of the outsole 16 corresponding with an arch area of the human foot of the size corresponding with the outsole and article of footwear 10. Accordingly, the midfoot region 20 is also referred to as the outsole arch region.

As used herein, a lateral side of a component for the article of footwear 10, such as a lateral edge 24 of the outsole 16, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for the article of footwear 10, such as a medial edge 26 of the outsole 16, is the side that corresponds with an inside area of the foot of the wearer and is generally closer to the other foot of the wearer (i.e., the side closer to the hallux of the foot of the wearer). The hallux is commonly referred to as the big toe. The lateral edge 24 and the medial edge 26 both extend around the periphery of the outsole 16 from the forwardmost edge 13 to the rearmost edge 15 of the outsole 16.

The outsole 16 includes an outsole body 32. The outsole body 32 can be a single-piece structure (i.e., a unitary structure) to enhance its structural integrity and can be manufactured using an insert molding process. The material for the outsole body 32 may be selected to provide a desirable combination of durability and flexibility. For example, the outsole body 32 may be wholly or partly made of a thermoplastic, such as a thermoplastic rubber, ethylene vinyl acetate (EVA) or other suitably durable material. As a non-limiting example, the outsole body 32 is wholly or partly made of thermoplastic polyurethane (TPU). It is contemplated that the outsole body 32 may be wholly or partly made of a transparent material. The outsole body 32 extends along the heel region 18, the midfoot region 20, and the forefoot region 22 and defines an outer body surface 33 (FIG. 2) for engaging the ground G and an inner body surface 35 (FIG. 3) for supporting the wearer's foot.

With reference to FIG. 4, the outsole 16 defines a central axis C intersecting an outsole midpoint OM of the maximum outsole length MOL. The outsole midpoint OM is defined as a point on the maximum outsole length MOL that divides the maximum outsole length MOL into two equal parts. In other words, the outsole midpoint OM is the halfway point of the maximum outsole length MOL. Thus, the distance O1 from the forwardmost edge 13 to the outsole midpoint OM along the longitudinal axis X is equal to the distance O2 from the rearmost edge 15 to the outsole midpoint OM along the longitudinal axis X. The central axis C is perpendicular to the longitudinal axis X. The outsole 16 includes a plurality of traction elements 34 each extending directly from the outsole body 32 away from the inner body surface 33. As a non-limiting example, the traction elements 34 may extend directly from the outer body surface 33 of the outsole body 32 to enhance the structure integrity of the outsole 16. The traction elements 34 may be configured as cleats or spikes to provide traction when the outsole 16 engages the ground G. As a non-limiting example, the traction elements 34 may have a substantially triangular shape sufficient to penetrate the ground G upon application of pressure by the wearer of the article of footwear 10. Each traction element 34 points toward the central axis X to provide traction specifically suited for speed golf. Thus, the traction elements 34 located in the forefoot region 22 point rearward, the traction elements 34 located in the heel region 18 point forward, and the traction elements 34 located in the midfoot region 20 generally point downward. During speed golf, the golfer has to run to minimize the time it takes to complete eighteen holes. For this reason, the traction elements 34 located in the forefoot region 22 (i.e., the forefoot traction elements 34*a*) point rearward to maximize traction during the "push off" when the wearer is running. While the wearer is running, the traction elements 34 located in the forefoot region 22 dig into the ground G, thereby aiding the wearer to propel forward. The traction elements 34 is in the heel region 18 (i.e., the heel traction elements 34*b*) point forward to maximize traction when the golfer is running downhill. While the wearer runs downhill, the traction elements 34 located in the heel region 18 dig into the ground G, thereby slowing the wearer. The traction elements 34 located in the midfoot region 20 (i.e., a midfoot traction element 34*c*) generally point downward to maximize traction during a golf swing. Therefore, the shape and orientation of the traction elements 34 provide traction to the outsole 16 that is specifically tailored for speed golf as described above.

With reference to FIGS. 4-7, each of the traction elements 34 (i.e., the forefoot traction elements 34*a*, the heel traction elements 34*b*, and the midfoot traction elements 34*c*) includes a base 36 coupled to the outer body surface 33. The base 36 and the outer body surface 33 can be coupled to each other to form a single-piece structure that can be manufactured using, for example, an insert molding process. Each traction element 34 further includes a tip 28 spaced apart from the outer body surface 33. The base 36 of each traction element 34 (i.e., the forefoot traction element 34*a*, the heel traction element 34*b*, and the midfoot traction element 34*c*) has a maximum base length MBL. The base 36 has a first base end 40 and a second base end 42, and the maximum base length MBL is defined from the first base end 40 to the second base end 42 along the longitudinal axis X.

The maximum base length MBL has a base midpoint BM. The base midpoint BM is defined as a point on the maximum base length MBL that divides the maximum base length MBL into two equal parts. In other words, the base midpoint BM is the halfway point of the maximum base length MBL. Thus, the distance B1 from the first base end 40 to the base midpoint BM along the longitudinal axis X is equal to the distance B2 from the second base end 42 to the base midpoint BM along the longitudinal axis X. Each of the traction elements 34 has a pitch defined by an angle A between an incline vector IV and a vector normal to the outer body surface 33 (i.e., the normal vector NV). The incline vector IV extends from the base midpoint BM of the maximum base length MBL to the tip 38. The pitch (as defined by the angle A) of each of the traction elements 34 increases as an increasing function of a distance D from the central axis C to a respective traction element 34 in order to specifically tailor the traction of the outsole 14 for speed golf as described above. In other words, the angle A of the traction elements 34 increases as the distance D from the central axis C to the respective traction element 34 increases. The distance D is measured from the central axis C to the tip 38 of the respective traction element 34. Each of the traction elements 34 defines a traction axis TX that intersects the tip 38 and the longitudinal axis X. The longitudinal axis X is perpendicular to the traction axis TX. The traction axis TX is parallel to the normal vector NV (i.e., the normal vector that is normal to the outer body surface 33). As discussed above, at least one of the traction elements 34 is located in the midfoot region 20 (i.e., the midfoot traction element 34*c*). One or more of the midfoot traction elements 34*c* is symmetrical about the traction axis TX. The forefoot traction elements 34*a* and the heel traction elements 34*b* are not symmetrical about the traction axis TX.

Figure 8:
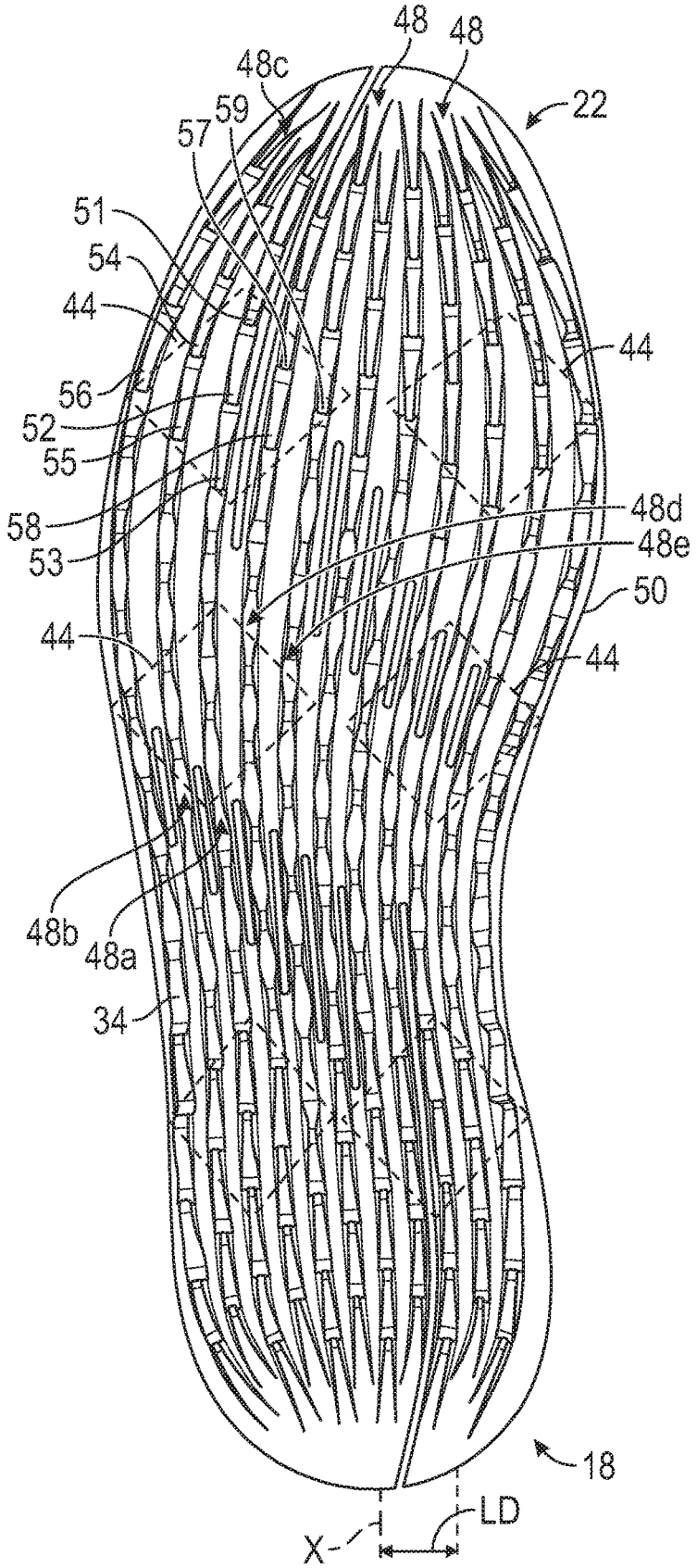
FIG. 8 is a schematic bottom view of the sole structure of FIG. 1.

With reference to FIG. 8, the traction elements 34 are arranged in a plurality of rows 48 that extends between the forefoot region 22 and the heel region 18 in order to provide traction during a golf swing. During a golf swing, the outsole 16 tends to rotate, causing slippage. It is desirable, however, to minimize slippage of the outsole 16 during a golf swing. Because the traction elements 34 are arranged in rows 48 that extend from the forefoot region 22 to the heel region 18, the undesirable slippage of the outsole 16 is minimized during a golf swing. The outsole 16 has a perimeter 50 that defines a perimeter contour. The premier contour has a variable perimeter curvature along the perimeter 50 of the outsole 16. Each of the rows 48 has a row contour. The row contour has a variable row curvature. The outsole defines a lateral distance LD from the longitudinal axis X to a respective row 48. The variable row curvature is closer to the variable perimeter curvature as the lateral distance LD from the longitudinal axis X to the respective row 48 increases. In other words, the, rows 48 are more linear in the center of the outsole 16, and the rows 48 that are closer to the perimeter 50 are more curved to follow the variable perimeter curvature.

With continuing reference to FIG. 8, the outsole 16 includes a plurality of anti-rotation areas 44 to prevent slippage during a golf swing. The anti-rotation areas 44 include a group of traction elements 34 that has a height that is greater than the height of the traction members 34 that are not in the anti-rotation areas 44. At least two of the anti-rotation areas 44 are located in the forefoot region 22, and at least two of the anti-rotation areas 44 are located in the heel region 18. As non-limiting example, the outsole 16 includes six anti-rotation areas 44 each spaced apart from each to minimize slippage during a golf swing. The group of the traction elements 34 at each of the plurality of anti-rotation areas 44 includes a first anti-rotation traction element 51, a second anti-rotation traction element 52, a third anti-rotation traction element 53, a fourth anti-rotation traction element 54, a fifth anti-rotation traction element 55, a sixth anti-rotation traction element 56, a seventh anti-rotation traction element 57, an eighth anti-rotation traction element 58, and a ninth anti-rotation traction element 59. The first anti-rotation traction element 51, the second anti-rotation traction element 52, and the third anti-rotation traction element 53 each have the same height (i.e., the first height). The first anti-rotation traction element, the second anti-rotation traction element, and the third anti-rotation traction element are each disposed along a first row 48*a* of the plurality of rows 48. The fourth anti-rotation traction element 54 and the fifth anti-rotation traction element 55 are disposed along a second row 48*b* of the plurality of rows 48. The second row 48*b* of the plurality of rows 48 is immediately adjacent to the first row 48*a* of the plurality of rows 48. The sixth anti-rotation traction element 56 is disposed along a third row 48*c* of the plurality of rows, and the third row 48*c* is immediately adjacent the second row 48*b* of the plurality of rows 48. The seventh anti-rotation traction element 57 and the eighth anti-rotation traction element 58 are disposed along a fourth row 48*d* of the plurality of rows 48. The fourth row 48*d* of the plurality of rows 48 is immediately adjacent the first row 48*a* of the plurality of rows 48. The ninth anti-rotation traction element 59 is disposed along a fifth row 48*e* of the plurality of rows 48 is immediately adjacent the fourth row 48*e* of the plurality of rows 48. The height of each of the first anti-rotation traction element, the second anti-rotation traction element, and the third anti-rotation traction element is greater than the height of each of the fourth anti-rotation traction element 54, the fifth anti-rotation traction element 55, the sixth anti-rotation traction element 56, the seventh anti-rotation traction element 57, the eighth anti-rotation traction element 58, and the ninth anti-rotation traction element 59 to minimize slippage of the outsole 16 during a golf swing.

Figure 9:
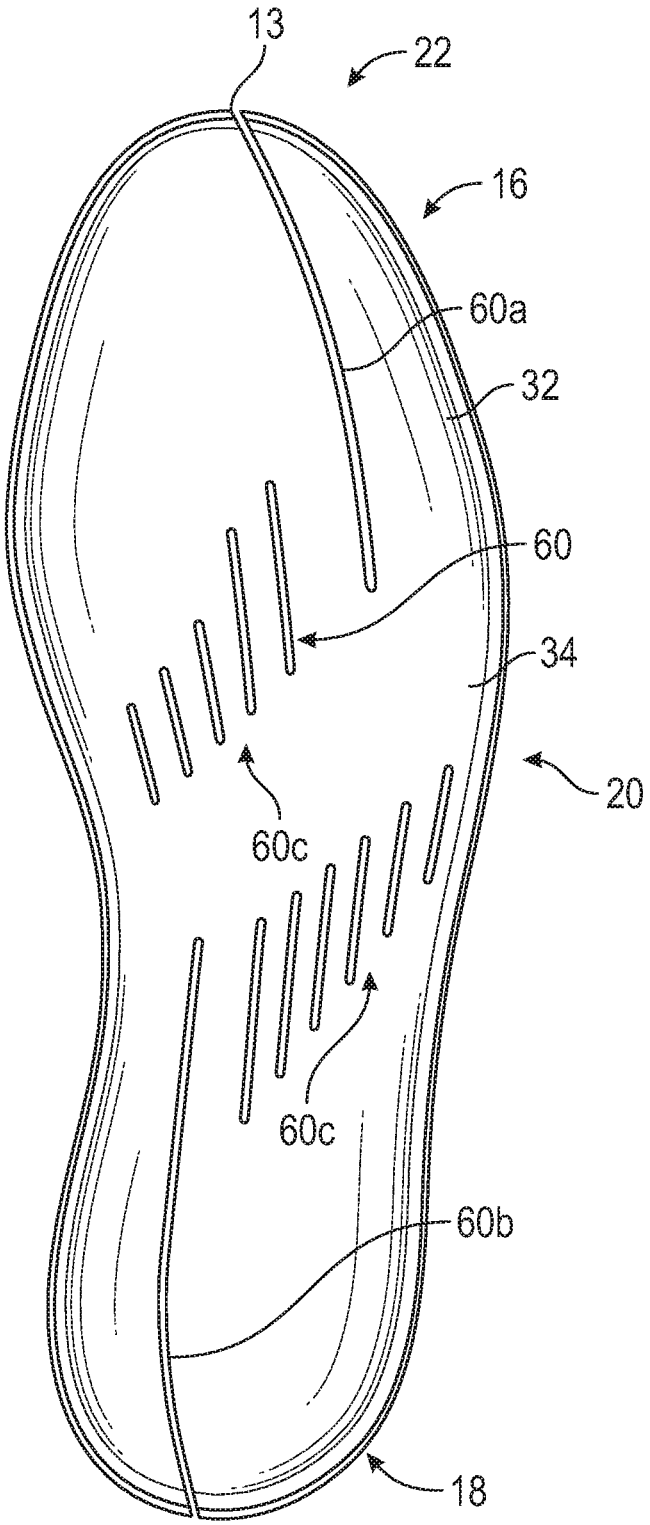
FIG. 9 is a schematic top view of the sole structure of FIG. 1.

With reference to FIG. 9, the outsole 16 defines a plurality of grooves 60 extending through an entire thickness of the outsole body 32 and disposed between the rows 48 of traction elements 34 to enhance the flexibility of the outsole 16. The grooves 60 include a first groove 60*a* extending from the forwardmost edge 13 of the outsole body 32 toward the midfoot region 20 to enhance the flexibility of the forefoot region 22 of the outsole 16. The grooves 60 includes a second groove 60*b* that extends from the rearmost edge 15 of the outsole body 32 toward the midfoot region 20 to enhance the flexibility of the heel region 18 of the outsole 16. The grooves 60 include a plurality of intermediate grooves 60*c* to enhance the flexibility of the midfoot region 20.

While the best modes for carrying out the teachings have been described in detail, those familiar with the art to which this disclosure relates will recognize various alternative designs and embodiments for practicing the teachings within the scope of the appended claims. The article of footwear 10 and sole structure 12 illustratively disclosed herein may be suitably practiced in the absence of any element which is not specifically disclosed herein. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings.

The invention claimed is:

1. A sole structure for an article of footwear, comprising:

an outsole having a maximum outsole length and extending along a longitudinal axis, wherein the maximum outsole length has an outsole midpoint, the outsole defines a central axis intersecting the outsole midpoint of the maximum outsole length of the outsole, the central axis is perpendicular to the longitudinal axis, and the outsole includes:

an outsole body defining an inner body surface and an outer body surface opposite the inner body surface;

a plurality of traction elements each extending from the outsole body away from the inner body surface;

wherein each of the plurality of traction elements includes:

a base coupled to the outer body surface, wherein the base has a maximum base length, and the maximum base length has a base midpoint;

a tip spaced apart from the outer body surface;

wherein each of the plurality of traction elements has a pitch defined by an angle between an incline vector and a vector normal to the outer body surface;

wherein the incline vector extends from the base midpoint of the maximum base length of the base to the tip; and wherein the pitch of each of the plurality of traction elements increases as an increasing function of a distance from the central axis to a respective traction element of the plurality of traction elements, and such that each of the plurality of traction elements points toward the central axis.

2. The sole structure of claim 1, wherein the outsole has a forefoot region, a heel region, and a midfoot region between the forefoot region and the heel region, each of the plurality of traction elements defines a traction axis, the traction axis intersects the tip and the longitudinal axis, the longitudinal axis is perpendicular to the traction axis, the traction axis is parallel to the vector normal to the outer body surface, at least one of the plurality of traction elements is located in the midfoot region, and the at least one of the plurality of traction elements that is located in the midfoot region is symmetrical about the traction axis.

3. The sole structure of claim 2, wherein the angle of the plurality of traction elements increases as the distance from the central axis to the respective traction element of the plurality of traction elements increases.

4. The sole structure of claim 3, wherein the base has a first base end and a second base end opposite the first base end, the maximum base length of the base is defined from the first base end to the second base end along the longitudinal axis, and each of the plurality of traction elements extends directly from the outer body surface of the outsole body, a distance from the first base end to the base midpoint along the longitudinal axis is equal to a distance from the second base end to the base midpoint along the longitudinal axis, the outsole includes a forwardmost edge and a rearmost edge opposite the forwardmost edge, the maximum outsole length is defined as a distance from the forwardmost edge to the rearmost edge of the outsole along the longitudinal axis, and a distance from the forwardmost edge to the outsole midpoint along the longitudinal axis is equal to a distance from the rearmost edge to the outsole midpoint along the longitudinal axis.

5. The sole structure of claim 4, wherein at least one of the plurality of traction elements is located in the forefoot region and is not symmetrical about the traction axis.

6. The sole structure of claim 5, wherein at least one of the plurality of traction elements is located in the heel region and is not symmetrical about the traction axis.

7. The sole structure of claim 1, wherein the outsole defines a plurality of grooves extending through an entire thickness of the outsole body.

8. The sole structure of claim 1, wherein the outsole has a forefoot region, a heel region, and a midfoot region between the forefoot region and the heel region, the plurality of traction elements are arranged in a plurality of rows that extends between the forefoot region and the heel region, the outsole has a perimeter that defines a perimeter contour, the perimeter contour has a variable perimeter curvature along the perimeter of the outsole, each of the plurality of rows has a row contour, the row contour has a variable row curvature, the outsole defines a distance from the longitudinal axis to a respective row of the plurality of rows, and the variable row curvature is closer to the variable perimeter curvature as the distance from the longitudinal axis to the respective row of the plurality of rows increases.

9. The sole structure of claim 1, wherein the outsole includes a plurality of anti-rotation areas, the plurality of traction elements includes a group of traction elements at each of the plurality of anti-rotation areas, each traction element of the group of traction elements has a height that is greater than a height of each of the plurality of traction elements that is not located in the anti-rotation areas.

10. The sole structure of claim 9, wherein the outsole includes a forefoot region, a heel region, and a midfoot region between the forefoot region and the heel region, the plurality of anti-rotation areas includes six anti-rotation areas each spaced apart from each other.

11. The sole structure of claim 10, wherein at least two of the plurality of anti-rotation areas are in the forefoot region of the outsole.

12. The sole structure of claim 11, wherein at least two of the plurality of anti-rotation areas are in the heel region of the outsole.

13. The sole structure of claim 12, wherein the plurality of traction elements are arranged in a plurality of rows that extends between the forefoot region and the heel region, the group of the plurality of traction elements at each of the plurality of anti-rotation areas includes a first anti-rotation traction element, a second anti-rotation traction element, a third anti-rotation traction element, a fourth anti-rotation traction element, a fifth anti-rotation traction element, a sixth anti-rotation traction element, a seventh anti-rotation traction element, an eighth anti-rotation traction element, and a ninth anti-rotation traction element, and the first anti-rotation traction element, the second anti-rotation traction element, and the third anti-rotation traction element each having a same height, and the first anti-rotation traction element, the second anti-rotation traction element, and the third anti-rotation traction element are each disposed along a first row of the plurality of rows.

14. The sole structure of claim 13, wherein the fourth anti-rotation traction element and the fifth anti-rotation traction element are disposed along a second row of the plurality of rows, and the second row of the plurality of rows is immediately adjacent to the first row of the plurality of rows.

15. The sole structure of claim 14, wherein the sixth anti-rotation traction element is disposed along a third row of the plurality of rows, and the third row is immediately adjacent the second row of the plurality of rows.

16. The sole structure of claim 15, wherein the seventh anti-rotation traction element and the eighth anti-rotation traction element are disposed along a fourth row of the plurality of rows, and the fourth row of the plurality of rows is immediately adjacent the first row of the plurality of rows.

17. The sole structure of claim 16, wherein the ninth anti-rotation traction element is disposed along a fifth row of the plurality of rows that is immediately adjacent the fourth row of the plurality of rows.

18. An article of footwear, comprising:

an upper;

an outsole having a maximum outsole length and extending along a longitudinal axis, wherein the maximum outsole length has an outsole midpoint, the outsole defines a central axis intersecting the outsole midpoint of the maximum outsole length of the outsole, the central axis is perpendicular to the longitudinal axis, and the outsole includes:

an outsole body defining an inner body surface and an outer body surface opposite the inner body surface;

a plurality of traction elements each extending from the outer body surface away from the inner body surface;

wherein each of the plurality of traction elements includes:

a base coupled to the outer body surface, wherein the base has a maximum base length, and the maximum base length has a base midpoint;

a tip spaced apart from the outer body surface;

wherein each of the plurality of traction elements has a pitch defined by an angle between an incline vector and a vector normal to the outer body surface;

wherein the vector extends from the outsole midpoint of the maximum base length of the base to the tip; and wherein the pitch of each of the plurality of traction elements increases as an increasing function of a distance from the central axis to a respective traction element of the plurality of traction elements, and such that each of the plurality of traction elements points toward the central axis.

19. The article of footwear of claim 18, wherein the outsole has a forefoot region, a heel region, and a midfoot region between the forefoot region and the heel region, each of the traction elements defines a traction axis, the traction axis intersects the tip and the longitudinal axis, the longitudinal axis is perpendicular to the traction axis, the traction axis is parallel to the vector normal to the outer body surface, at least one of the plurality of traction elements is located in the midfoot region, and the at least one of the plurality of traction elements that is located in the midfoot region is symmetrical about the traction axis.

20. The article of footwear of claim 19, wherein the angle of the plurality of traction elements increases as the distance from the central axis to the respective traction element of the plurality of traction elements increases, the outsole has a forefoot region, a heel region, and a midfoot region between the forefoot region and the heel region, and at least one of the plurality of traction elements is located in the forefoot region and is not symmetrical about the traction axis, at least one of the plurality of traction elements is located in the heel region and is not symmetrical about the traction axis, the outsole defines a plurality of grooves extending along an entire thickness of the outsole body.

21. The article of footwear of claim 20, wherein the outsole has a forefoot region, a heel region, and a midfoot region between the forefoot region and the heel region, the plurality of traction elements are arranged in a plurality of rows that extends between the forefoot region and the heel region, the outsole has a perimeter that defines a perimeter contour, the perimeter contour defines a variable perimeter curvature along the perimeter of the outsole, each of the plurality of rows has a row contour, the row contour defines a variable row curvature, the outsole defines a distance from the longitudinal axis to a respective row of the plurality of rows, the variable row curvature is closer to the variable perimeter curvature as the distance from the longitudinal axis to the respective row of the plurality of rows increases, the outsole includes a plurality of anti-rotation areas, the plurality of traction elements includes a group of traction elements at each of the plurality of anti-rotation areas, each traction element of the group of traction elements has a height that is greater than a height of each of the plurality of traction elements that is not located in the anti-rotation areas, the plurality of anti-rotation areas includes six anti-rotation areas each spaced apart from each other.

22. The article of footwear of claim 21, wherein at least two of the plurality of anti-rotation areas are in the forefoot region of the outsole, at least two of the plurality of anti-rotation areas are in the heel region of the outsole, the plurality of traction elements are arranged in a plurality of rows that extends between the forefoot region and the heel region, the group of the plurality of traction elements at each of the plurality of anti-rotation areas includes a first anti-rotation traction element, a second anti-rotation traction element, a third anti-rotation traction element, a fourth anti-rotation traction element, a fifth anti-rotation traction element, a sixth anti-rotation traction element, a seventh anti-rotation traction element, an eighth anti-rotation traction element, and a ninth anti-rotation traction element, and the first anti-rotation traction element, the second anti-rotation traction element, and the third anti-rotation traction element each having a same height, and the first anti-rotation traction element, the second anti-rotation traction element, the third anti-rotation traction element are each disposed along a first row of the plurality of rows, the fourth anti-rotation traction element and the fifth anti-rotation traction element are disposed along a second row of the plurality of rows, and the second row of the plurality of rows is immediately adjacent to the first row of the plurality of rows.

23. The article of footwear of claim 22, wherein the sixth anti-rotation traction element is disposed along a third row of the plurality of rows, and the third row is immediately adjacent the second row of the plurality of rows, the seventh anti-rotation traction element and the eighth anti-rotation traction element are disposed along a fourth row of the plurality of rows, the fourth row of the plurality of rows is immediately adjacent the first row of the plurality of rows, the ninth anti-rotation traction element is disposed along a fifth row of the plurality of rows is immediately adjacent the fourth row of the plurality of rows.

* * * * *